US008056969B2

(12) United States Patent
Grace et al.

(10) Patent No.: US 8,056,969 B2
(45) Date of Patent: Nov. 15, 2011

(54) COLLAPSIBLE ARTICLES OF FURNITURE

(75) Inventors: Daniel R. Grace, Old Saybrook, CT (US); Scott J. Kasper, Killingworth, CT (US)

(73) Assignee: GCI Outdoor, Inc., Higganum, CT (US)

( * ) Notice: Subject to any disclaimer, the term of this patent is extended or adjusted under 35 U.S.C. 154(b) by 279 days.

(21) Appl. No.: 12/257,038

(22) Filed: Oct. 23, 2008

(65) Prior Publication Data

US 2009/0102248 A1 Apr. 23, 2009

Related U.S. Application Data

(60) Provisional application No. 60/981,986, filed on Oct. 23, 2007.

(51) Int. Cl.
*A47C 4/50* (2006.01)

(52) U.S. Cl. ..... 297/56; 297/42; 297/55; 297/16.2

(58) Field of Classification Search ..... 297/16.2, 297/42, 55, 56; 248/159, 165–166, 168, 248/188.2; 403/52, 59
See application file for complete search history.

(56) References Cited

U.S. PATENT DOCUMENTS

| | | | | |
|---|---|---|---|---|
| 1,209,679 | A | 12/1916 | Decker | |
| 4,714,224 | A * | 12/1987 | Calmes | 248/465 |
| 4,810,029 | A * | 3/1989 | Kaladis et al. | 297/16.2 |
| 5,498,054 | A * | 3/1996 | Tomlinson | 297/16.2 |
| 5,522,642 | A * | 6/1996 | Herzog | 297/344.18 |
| 5,876,091 | A * | 3/1999 | Chernomashentsev | 297/16.2 |
| 6,471,288 | B2 * | 10/2002 | Alexander, Jr. | 297/56 |
| 6,634,704 | B1 * | 10/2003 | Bergquist | 297/16.2 |
| 6,687,928 | B1 * | 2/2004 | Wilson | 5/99.1 |
| 2007/0228780 | A1 | 10/2007 | Grace | |

FOREIGN PATENT DOCUMENTS

| | | | |
|---|---|---|---|
| CN | 2710459 | Y | 7/2005 |
| DE | 9011584 | U1 | 10/1990 |

OTHER PUBLICATIONS

International Search Report for corresponding PCT application No. PCT/US2008/012057 dated Jun. 1, 2009.

Supplementary European Search Report from corresponding European Application No. 08840958 dated Jan. 27, 2011 (4 pages).

* cited by examiner

*Primary Examiner* — David Dunn
*Assistant Examiner* — Erika Garrett
(74) *Attorney, Agent, or Firm* — McCormick, Paulding & Huber LLP

(57) ABSTRACT

Collapsible articles of furniture are provided which have at least one leg assembly which includes a first leg and a second leg. The first leg has a first upper leg segment and a first lower leg segment coupled to the upper leg segment by a first link and the second leg has a movable second upper leg segment and a fixed second lower leg segment coupled to the upper leg segment by a second link. The two links are pivotally connected to each other for movement between an open position wherein the first and second legs cross each other to form a generally X-shaped configuration and a closed position wherein the upper and lower leg segments are aligned with each other and the upper leg section of the first leg is received within the lower leg section of the second leg and is aligned with and telescopically received within the lower leg section of the first leg. The pair of control links pivotally supported in a space between the link plates move in response to movement of the plates prevent telescopic connection between the upper and lower leg segments and prevent the upper leg segments from being telescopically received within the lower leg segments until a predetermined condition of alignment between the upper and lower leg segments has been attained.

10 Claims, 8 Drawing Sheets

COLLAPSIBLE ARTICLES OF FURNITURE

CROSS REFERENCE TO RELATED APPLICATION

This application claims the benefit of U.S. Provisional Application Ser. No. 60/981,986, filed Oct. 23, 2007, the disclosure of which is hereby adopted by reference in its entirety as a part of the present application.

FIELD OF THE INVENTION

This invention relates in general to collapsible articles of furniture and more particularly to collapsible articles of outdoor furniture of a type preferably fabricated from metal.

BACKGROUND OF THE INVENTION

The present invention is concerned with improvements in portable collapsible metal outdoor furniture of simple durable quality construction which may be collapsed to minimal size to satisfy the needs of the average sportsman, camper, and generally all round outdoor enthusiast and for marketing at a reasonable price to satisfy the requirements of mass marketing.

SUMMARY OF THE INVENTION

In accordance with the present invention, a collapsible article of furniture is provided which has at least one leg assembly which includes a first leg and a second leg. The first leg has a movable first upper leg segment and a fixed first lower leg segment coupled to the first upper leg segment by a first link. The second leg has a second upper leg segment and a fixed second lower leg segment coupled to the upper leg segment by a second link. The two links are pivotal relative to each other between an open position wherein the first and second legs cross each other to form a generally X-shaped configuration and a closed position wherein the upper and lower leg segments are aligned with each other and the upper leg segment of the first leg is received within the lower leg segment of the second leg and is aligned with and telescopically received within the lower leg segment of the first leg. The pair of control links pivotally supported in a space between the link plates move in response to movement of the plates to prevent telescopic connection between the upper and lower leg segment and prevent the upper leg segments from being telescopically received within the lower leg segments until a predetermined condition of alignment between the upper and lower leg segments has been attained.

DETAILED DESCRIPTION OF PREFERRED EMBODIMENTS

Figure 1:
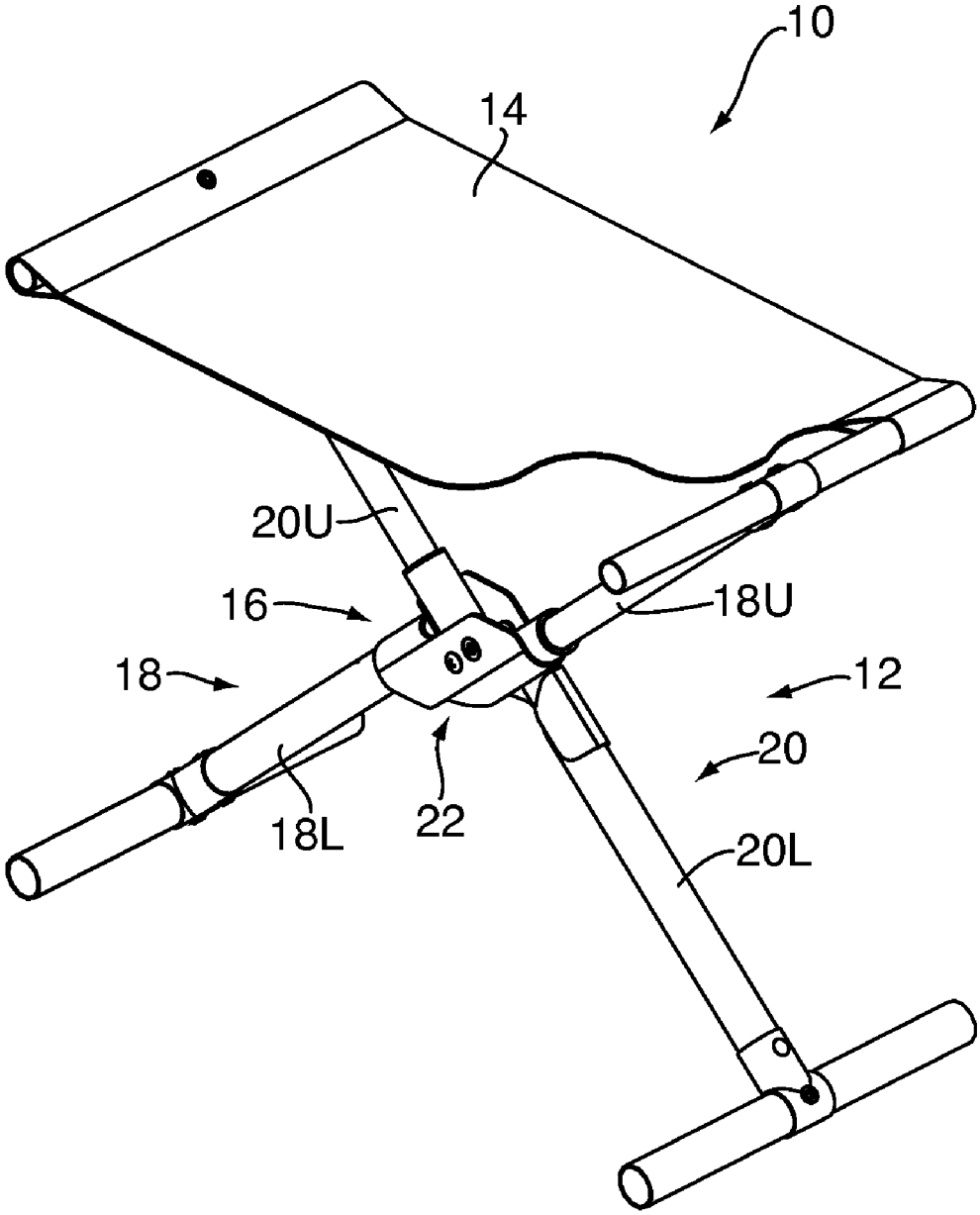
FIG. 1 is a perspective view of a two legged camp stool embodying the invention.

In the drawings and the descriptions which follow, the present invention is illustrated and described with reference to various collapsible articles of furniture embodying the present invention. In this specification, relative directional terms such as "top", "bottom", "upper", "lower", "front", "rear", "longitudinal", and "transverse" are employed for convenience of description and refer to various elements and component parts of each article of furniture in the orientations in which the article appears in the drawings. However, it should be understood that the various structural components hereinafter described may be operated and utilized in any orientation in an associated article of furniture.

Figure 2:
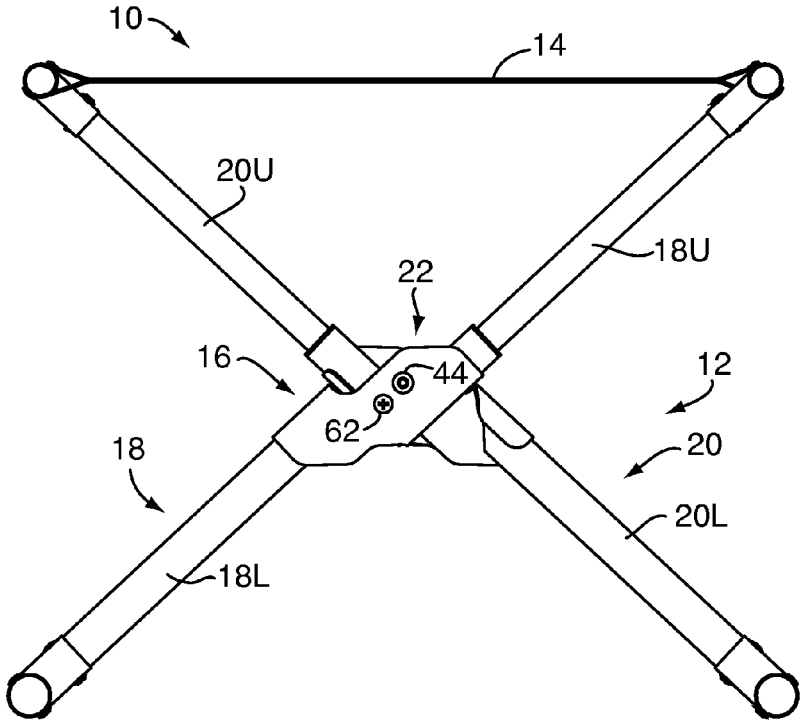
FIG. 2 is a front elevational view of the camp stool of FIG. 1.
Figure 3:
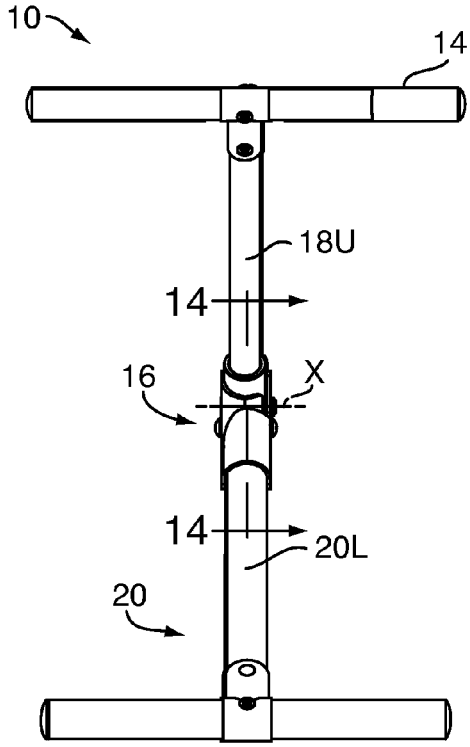
FIG. 3 is a side elevational view of the camp stool of FIGS. 1 and 2.

Turning now to the drawings and referring first particularly to FIGS. 1-5, a collapsible two legged seat or camp stool of cross-legged type embodying the present invention is designated generally by the reference number 10. The illustrated stool 10 essentially comprises a collapsible supporting structure or frame indicted generally at 12 which forms the base of the stool 10 and supports a generally rectangular flexible fabric seat panel 14 in a horizontally disposed position when the stool 10 is in its setup or open position ready for use as it appears in FIGS. 1-3. In FIGS. 1-3, the stool is shown with a portion of the seat panel broken away to reveal a part of the frame which support the panel.

Considering the frame in general, and further referring to FIGS. 1-5, in accordance with presently preferred construction, the frame 12 is fabricated from tubular metal such as steel or aluminum and has a single leg assembly 16 which includes collapsible first and second legs indicated generally at 18 and 20 and centrally connected, each to the other, by a common central linkage assembly 22 for limited angular movement about a pivot axis X relative to each other between open and closed positions, as will be hereinafter further discussed. In accordance with presently preferred construction, tee bars are connected to both the upper and lower ends of the collapsible legs 18 and 20 substantially as shown in FIG. 1. The tee bars at the upper end of the frame 12 support the fabric seat panel 14, whereas the tee bar at the lower end of the collapsible legs 18 and 20 provide the support base for the stool 10. The upper and lower tee bars are preferably releasably retained on the leg assembly 16 by spring biased detent buttons contained within respective end portions of the tubular legs to facilitate separation from the leg assembly 16 when the frame 12 is broken down for transportation and/or storage. It should be noted that in FIGS. 4 and 5 the leg assembly 16 is shown after the lower and upper tee bars and the flexible seat panel 14 have been removed.

Further considering the leg assembly 16 and further referring particularly to FIGS. 2-5, the first and second legs 18 and 20 are substantially identical to each other. Each leg is formed by a pair of substantially identical longitudinally axially extending tubular leg segments coupled together in longitudinally axially parallel and transversely offset relation to each other. The segments which comprise each leg are coupled together in transversely offset relation to each other by a pair of associated identical center link plates 18C and 20C. More specifically, and referring particularly to FIG. 2, the leg assembly 16 has a first leg 18 having discrete upper and lower leg segments indicated respectively at 18U and 18L. The two separated leg segments which comprise the leg 18 are mounted at opposite ends of link plate 18C, the lower leg segment 18L being mounted in fixed position on the lower end of the link plate. The upper leg segment 18U is mounted on the upper end of the link plate 18C for movement in one end of the opposite directional sense and in the direction of its longitudinal axis. In order to better illustrate the relative arrangement of the leg segments the axes of the leg segments 18U and 18L are indicated on FIG. 4 at 24A and 24B, respectively. An axial plane containing the axis X of the leg assembly 16 and parallel to the axes 24A and 24B is also shown and indicated by the letter P. It should be noted that the axis 24A is offset to the right of the plane P whereas the axis 24B is transversely offset to the left of the plane by an equal amount. It should also be noted that the axes of the leg 20 are similarly off set, but in opposite directions from those of the leg 18. As previously noted, the leg assembly 16 is pivotably moveable between an open or set up position shown in FIG. 2 and a closed position illustrated by FIG. 4. In the closed position shown in FIG. 4, the upper leg segments 18U and 20U are fully extended. The geometry of the leg assembly 16, as generally explained with reference to FIG. 2, is such that the upper leg segment of each leg is coaxially aligned with the lower leg section of the other of the legs when the leg assembly is in a closed position as it appears in FIG. 4.

Figure 4:
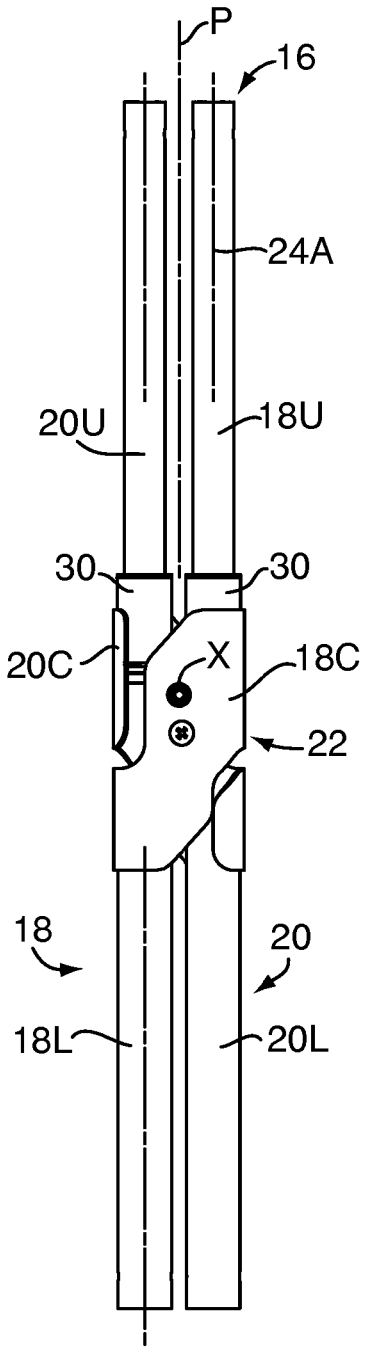
FIG. 4 is a front elevational view of the camp stool leg assembly shown in closed position with the upper leg segments in extended position.
Figure 5:
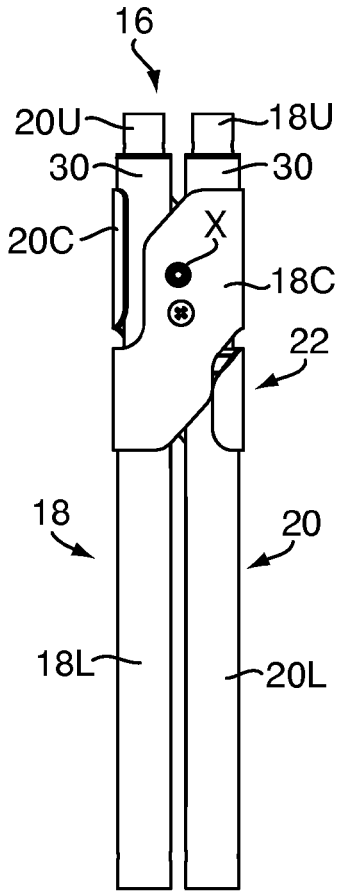
FIG. 5 is a front elevational view of the leg assembly of FIG. 4 shown with the upper leg segments in retracted or collapsed position.

In accordance with the present invention, the upper leg segments 18U and 20U are not telescopically engaged with the lower 20L and 18L when the leg assembly 16 is in its closed position of FIG. 4 with the upper legs fully extended as shown. In FIG. 5 the leg assembly 16 is shown after it has been moved to its fully collapsed position wherein a substantial portion of the upper leg segments of each one of the legs is telescopically received within the lower leg segments of the other of the legs.

The recommended procedure for collapsing the stool 10 is to release and remove the upper and lower tee bars from the leg assembly 16 together with the seat panel. Thereafter, the leg assembly may be readily collapsed by first pivoting the upper leg segments toward each other and to the fully closed position, wherein the upper leg segment 18U of the upper leg 18 will be coaxially aligned with the lower leg segment 20L of the leg 20 and the upper leg segment 20U of the leg 20 will be in coaxial alignment with the lower leg segment 18L of the lower leg 18. After the latter step has been performed, the lower ends of the fixed lower leg segments 18L and 20L should be rested on an appropriate supporting surface while light downward force is applied to the upper ends of the upper leg segments. If these operations are performed with a reasonable degree of care, each upper leg segment should slide downwardly within its associated sleeve bushing to establish telescopic engagement between the lead surface on the lower end portion of each arresting plug 40 and the ellipsoidal lead opening in its associated lower leg segment and to a position wherein a substantial portion of the upper leg segment is telescopically received within its associated lower leg segment. The four tee bars may then be arranged in parallel/side by side relation to each other and bundled with the flexible seat panel 14 for transportation and/or storage within a suitable pouch or carrying case (not shown).

If a person unfamiliar with the proper procedure for collapsing the stool attempts to pivot the legs toward closed position while simultaneously applying a downward force to the upper leg segments, which are not yet coaxially aligned with the lower leg segments, an annoying and perhaps serious problem may and usually does occur resulting in a jamming of the misaligned upper and lower leg segments. The problem usually occurs when premature movement of one or both of the upper leg segments is attempted during the final 20 or 30 degrees of angular movement of the leg assembly toward closed position.

If, during the pivotal closing movement of the leg assembly and the simultaneous downward movement of the upper leg segments toward its telescopically collapsed position one of the upper leg segments moves ahead of the other of the upper leg segments a jamming could occur interrupting the otherwise smooth transitional movement which could interrupt or prevent smooth operation. The novel inventive solution to the afore described problem will be apparent from the further detailed description of the leg assembly 16 which follows.

Figure 6:
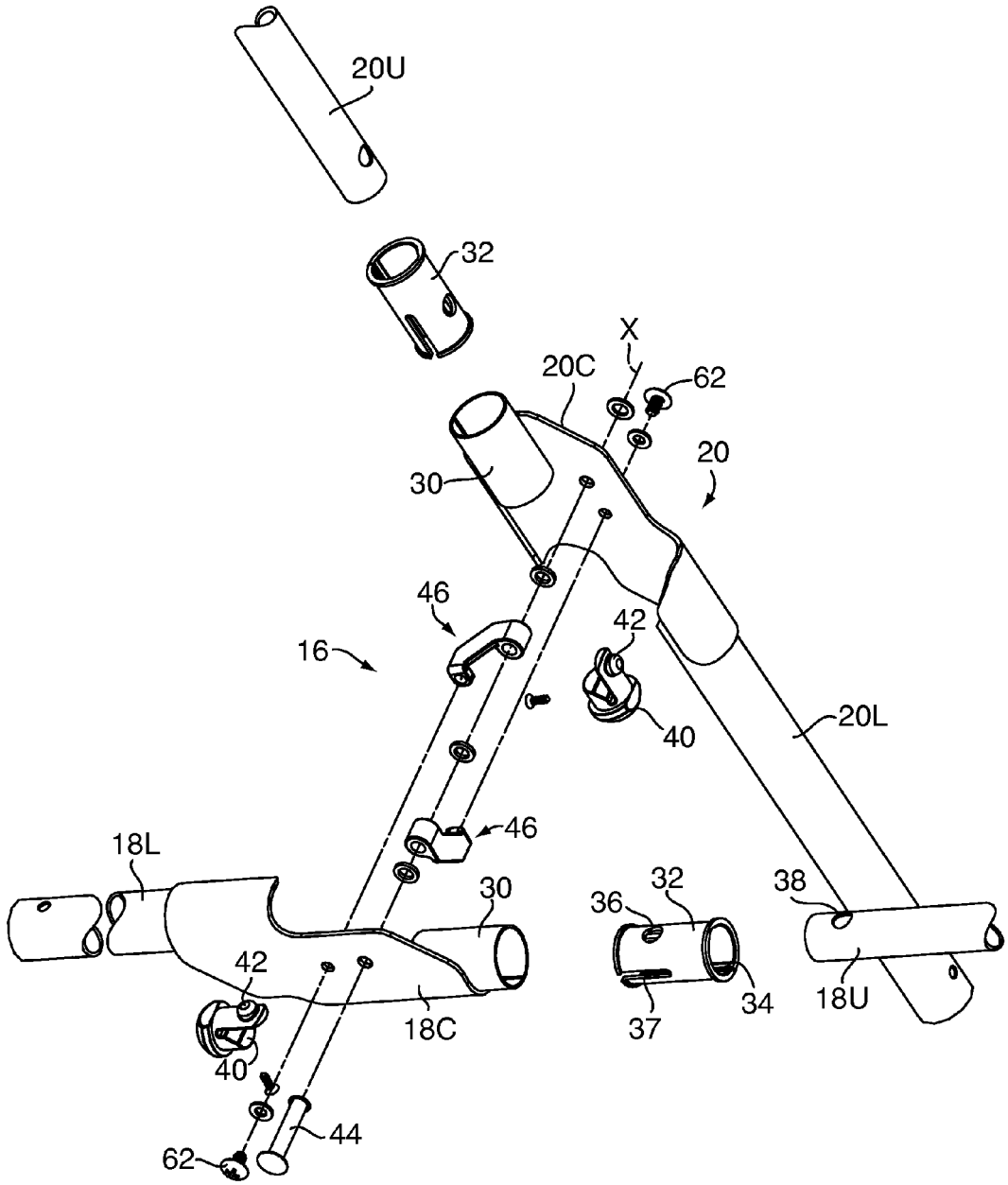
FIG. 6 is an exploded perspective view of a leg assembly.
Figure 7:
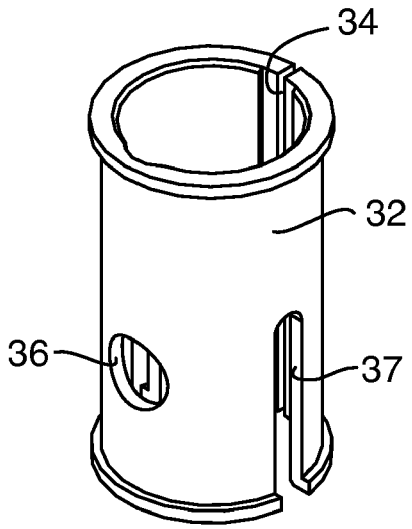
FIG. 7 is a somewhat enlarged perspective view of a sleeve bushing.
Figure 8:
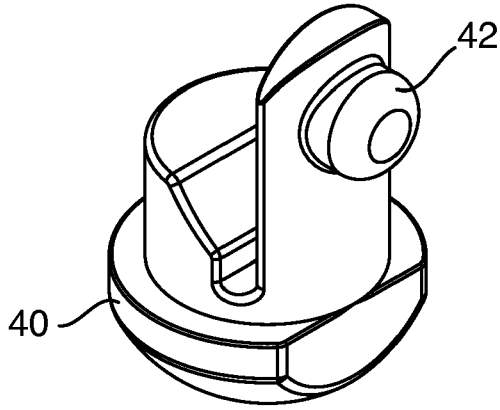
FIG. 8 is a somewhat enlarged perspective view of an arresting plug.
Figure 14:
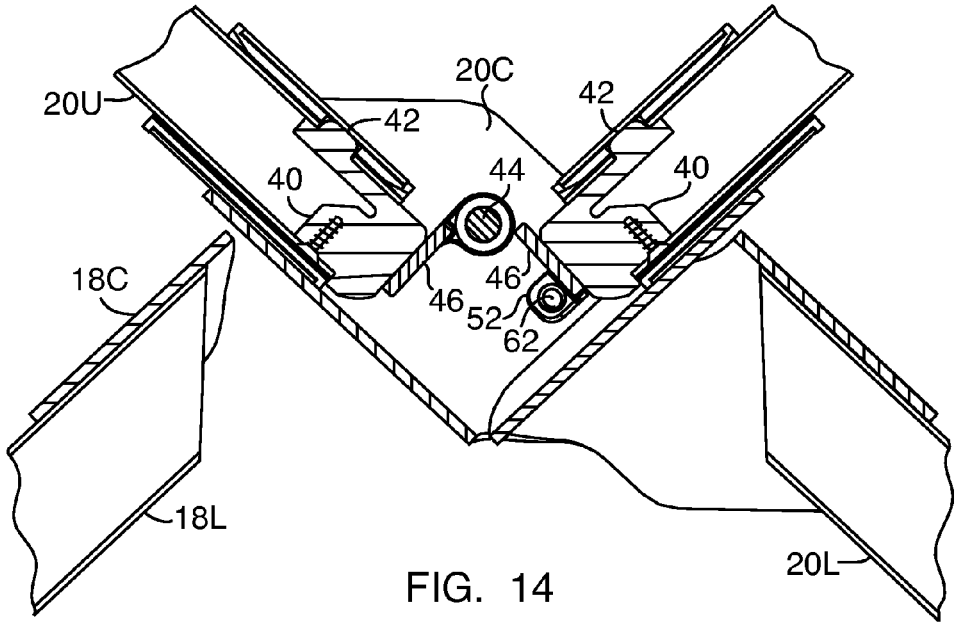
FIG. 14 is a somewhat enlarged fragmentary axial sectional view through the link assembly taken along the line 14-14 of FIG. 3.
Figure 15:
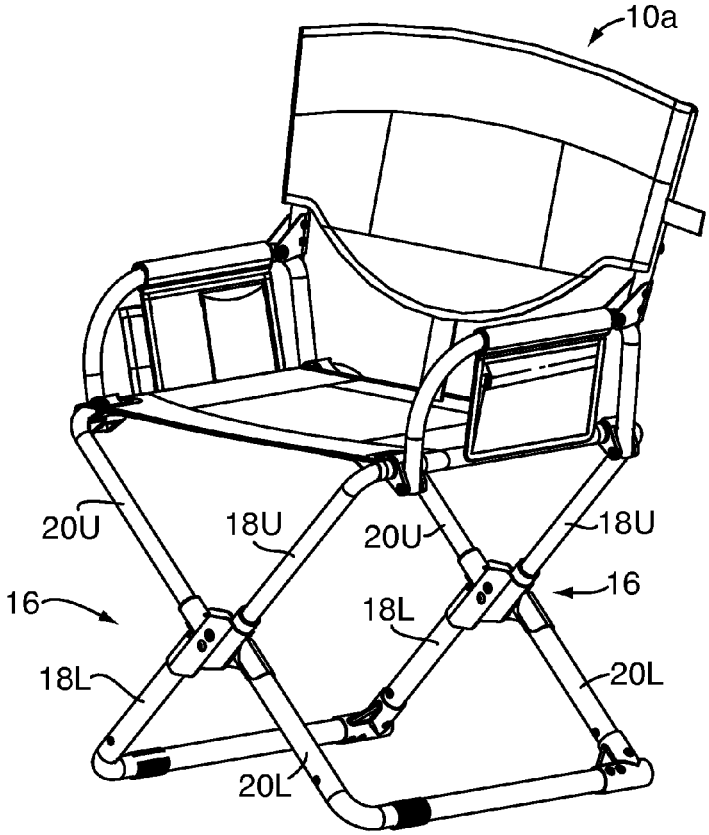
FIG. 15 is a perspective view of a lounge chair embodying the present invention.

Referring now to the exploded perspective view of the leg assembly 16 which appears in FIG. 6 the various elements which comprise the leg assembly and the relative positions of those elements are shown. The assembly includes the pair of legs 18 and 20. Since the two legs are substantially identical only the leg 18 is hereinafter further described. The link plates 18C and 20C are formed from substantially identical flat metal blanks. The metal blank from which the link 18C is fabricated has a tab extending from one side thereof which is contoured to complement an associated portion of the lower leg segment 18L which is welded to the tab. The upper end of the cylindrical tubular lower leg segment 18L is cut on the bias relative to the longitudinal axis of the cylindrical tube, as best shown in FIG. 14, to provide an ellipsoidal lead opening for receiving the plugged lower end of the movable upper leg segment 20U therein. Another tab integrally formed on the opposite side of the link 18C is contoured to complement an associated portion of a metal sleeve 30 which is also welded to the link plate 18C. A sleeve bushing 32 best shown in FIG. 7 has a slot 34 extending through and axially along the entire length of its cylindrical body. The sleeve bushing also has a cylindrical aperture 36 extending through its sidewall diametrically opposite the slot 34. Annular retaining flanges on opposite ends of the bushing project radially outwardly therefrom to anchor the bushing coaxially within the sleeve 30. Another slot 37 allows the resilient bushing 32 to be circumferentially compressed to facilitate assembly within the bore of the sleeve 30 wherein it is retained by the annular flanges at its opposite ends. The longitudinally axially elongated cylindrical tubular upper leg segment 18U and has an aperture 38 in its side wall near its lower end for registry with the aperture 36 formed in the side wall of the sleeve bushing. The lower end of the upper leg segment 18U is fitted with an arresting plug 40, best shown in FIG. 8, and which has an integral resilient cantilever tab thereon which carries a detent button 42. The detent button 42 is radially outwardly biased through the aperture 38 in the lower end of the upper leg segment 18U and retains the plug in assembly with the upper leg segment 18U. A welded bead (not shown) located on the outer surface of the leg segment 18U extends in an axial direction along substantially the entire axial length of the upper leg segment 18U diametrically opposite the aperture 38 and travels within the slot 34 in its supporting sleeve bushing 32 to maintain the detent button 42 in registration alignment with the aperture 36 and the bushing aperture 38 in the sleeve bushing which supports the upper leg segment for movement between its extended and retracted position. When the upper leg segment 18U is in its fully extended position, the detent button 42 will be engaged within the aperture 38, and the bushing aperture 36 and will maintain the upper leg segment 18U in its fully extended position until it is dislodged from the latter position by a light downward force applied to the upper end of the leg segment 18U.

The link plates 18C and 20C which form the center linkage 22 are connected to each other by a pivot pin formed by a rivet 44 having an enlarged head on one end and upset at its opposite end to retain the center link plates 18C and 20C in assembly for limited pivotal movement relative to each other.

As previously noted, the upper leg segments are and must be out of telescopic engagement with the lower leg segments of the leg assembly when the assembly is in its closed position with the upper leg segments in extended position. When the latter condition exists, there is a substantial gap between the lower ends of the upper leg segments and the open upper ends of the lower leg segments in which the upper segments are telescopically received. This gap occurs within the linkage 22. As a consequence of this gap an upper leg segment interference problem can occur between the moveable upper leg segments are moved across the gap and toward or into telescopic engagement with the lower leg segments during movement to retracted or collapsed position. The present invention overcomes this problem.

In accordance with the present invention, the linkage 22 includes a pair of substantially identical control links indicated generally at 46, 46. Although substantially identical, unlike other identical parts of the present structure which bear the same reference numerals the control links are identified by different reference numerals to assure clarity in the further description which follows.

Figure 9:
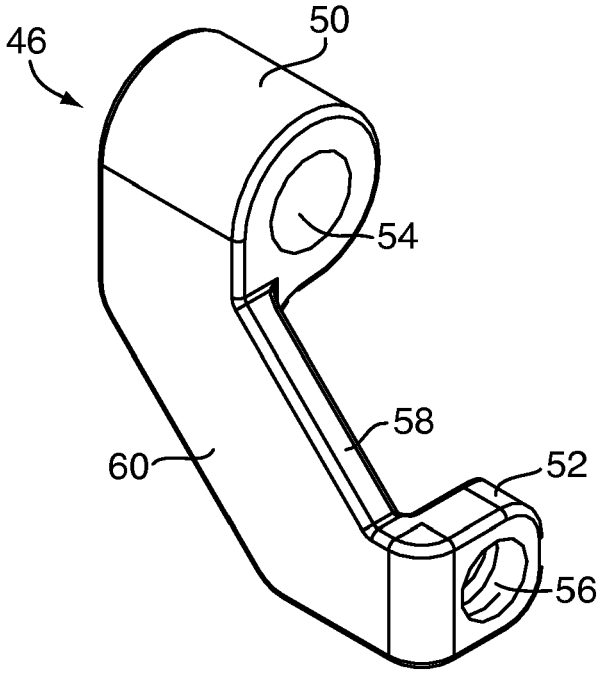
FIG. 9 is a somewhat enlarged perspective view of a control link.
Figure 10:
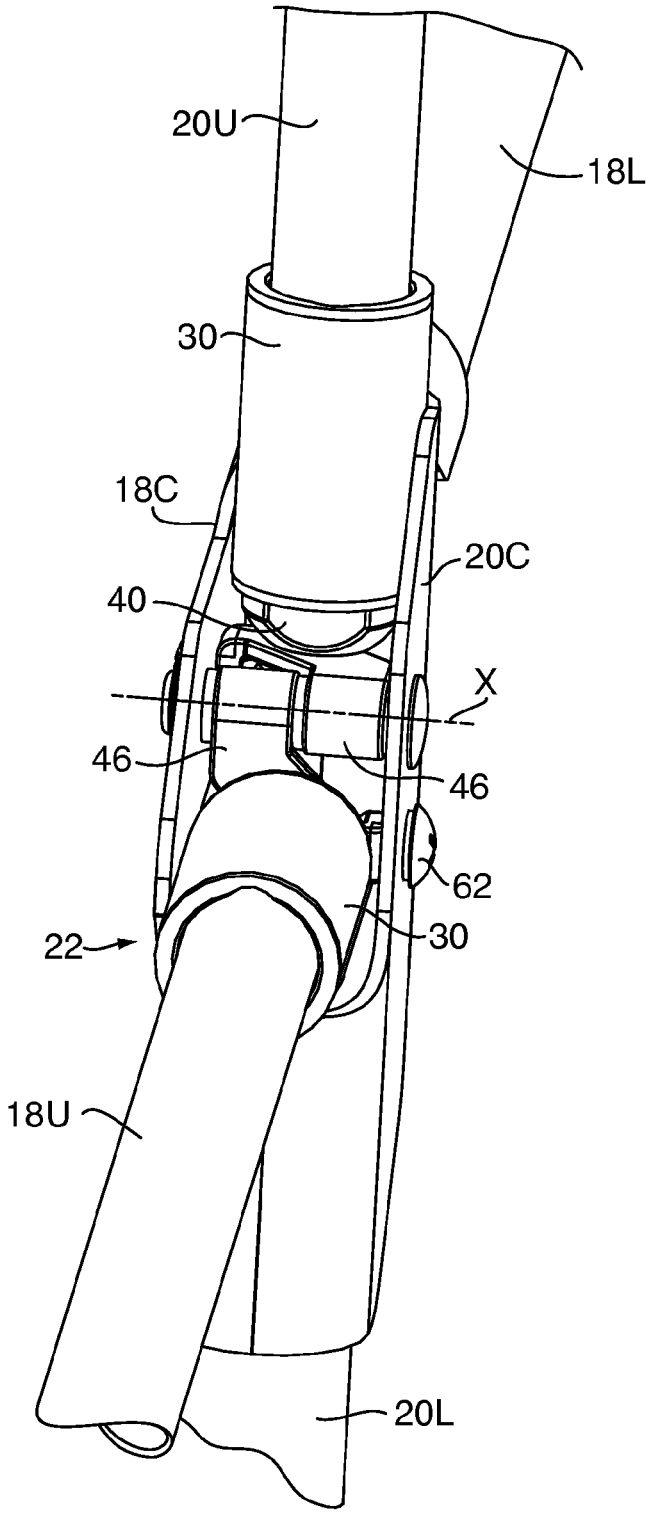
FIG. 10 is a somewhat enlarged fragmentary perspective view of the link assembly as viewed from above.

Each control link 46, one shown in FIG. 9, is preferably a unitary metal casting having bosses 50 and 52 at its opposite ends. The larger boss 50 has a smooth cylindrical bore 54 extending through it and sized to be slidably received on the pivot pin or rivet 44 for pivotal movement on the rivet. The smaller boss 52 has a threaded bore 56 extending through it in axially parallel alignment with the smooth bore 54. An integral generally rectangular connecting portion indicated at 58 extends between the bore portions 54 and 56 in generally diagonally incline inclined relation to the axes of the bores 54 and 56 and defines a substanitially smooth abutment or control surface 60 the plane of which is parallel to the axes of the control link bores. The two control links 46, 46 are mounted on the pivot pin 44 between the inner surfaces of the two link plates 18C and 20C with spacing washers therebetween as will be evident from the exploded perspective view of the leg assembly shown in FIG. 6. When the linkage 22 is assembled the control links and washers collectively cooperate to form a spacer between the opposing inner surfaces of the link plates 18C and 20C to assure proper clearance between the upper and lower leg segments and the linkage for smooth pivotal movement of the linkage 22. Each of the links 46, 46 is mounted on the pivot pin with its boss 50 generally adjacent the inner surface of an associated one of the links 18C 20C and its smaller or threaded boss 52 immediately adjacent the inner surface of the opposite link plate. The threaded boss 52 is secured in fixed position to the said opposite link plate by a threaded fastener 62 which passes through an aperture in the opposite link plate and is positioned below the axis X of the leg assembly. The general arrangement of the control links 46, 46 relative to the linkage 22 will be further apparent from FIG. 10, a fragmentary perspective view of the linkage 22 looking downward into the space between the opposing link plates 18C and 20C. In FIG. 10, the leg assembly 16 is shown when the linkage 22 is in its position of FIGS. 1 and 2. Thus, it will be apparent that each control link will move with the link plate to which it is fixedly attached.

Figure 13:
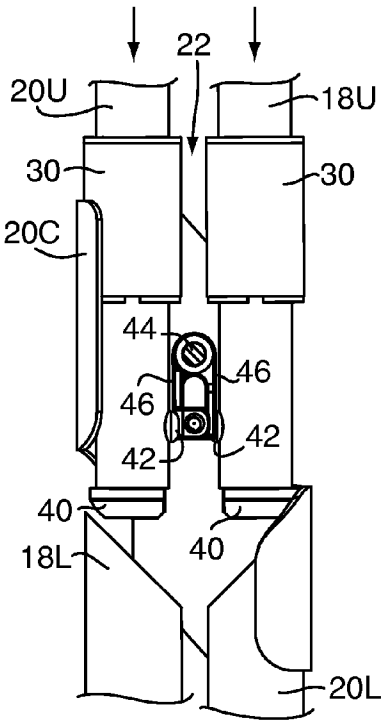
FIG. 13 is similar to FIG. 11 but shows the linkage in closed position.
Figure 12:
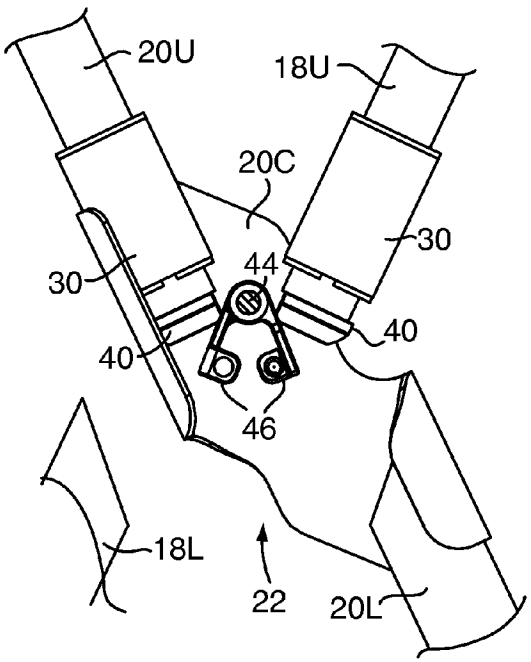
FIG. 12 is similar to FIG. 11 but shows the link assembly in another position.
Figure 11:
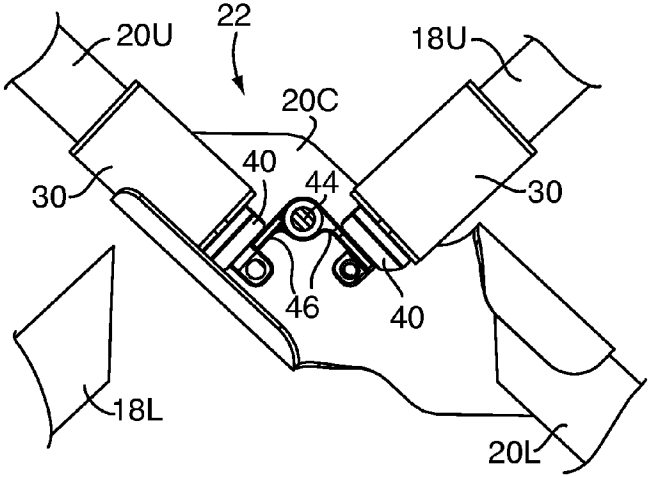
FIG. 11 is a somewhat enlarged fragmentary perspective view of a link assembly shown in open position with a link removed therefrom to reveal structure there behind.

Turning now to FIGS. 11-13, the linkage 22 is shown with the link plate closest to the viewer removed from the assembly to reveal the control link mechanism disposed within the linkage. FIG. 11 shows the position of the control links relative to the upper link segments when the leg assembly is in its open position of FIGS. 1 and 2. It should be noted that the angular relationship of the control links 46, 46 matches that of the movable upper legs 18U and 20U. It should be noted that when the assembly 22 is in its fully opened position the control or abutment surfaces 60, 60 on the control links 46, 46 are in abutting engagement with substantially flat abutment surfaces on the lower ends of the plugs 40, 40 as shown in FIGS. 11 and 14.

Considering now FIG. 13 the linkage 22 is shown in fully closed position. It should be noted that the position of the control links matches the position of the link plates which control the movements of the control links. It should be noted that the control links are positioned out of the paths of the movable upper leg segments which are moving downwardly in the direction indicated by the directional arrows which appear above the linkage. The leg assembly of FIG. 13 is being properly operated, the upper leg segments being in coaxial alignment with the lower leg segments. Considering now FIG. 12 which illustrates an improper operating procedure. The control links are in a proper operating position, the angle between the two links being substantially equal to the angle between the upper leg segments. It should now be noted that the upper leg segments are out of coaxial alignment with the lower leg segments because the upper leg segments are being moved downwardly prematurely, that is before the linkage 22 has been fully closed. It should now be apparent that the control link mechanism provides means for preventing movement of the upper leg segment into telescopic engagement it be lower leg segments before the upper and lower leg segments are coaxially aligned with each other.

Referring once again to FIG. 11, it should be apparent that as the linkage is opened the control links 46, 46 which are moved by the moving link plates apply generally upwardly directed force upon the plugs 40, 40 at the lower ends of the upper leg segments 18U and 20U and ultimately seat the upwardly extending upper leg segments in their respective fully extended positions. It should be further apparent that the link mechanism also provides a means for properly positioning the upper leg segments in response to opening movement of the linkage. It should be further apparent that when the linkage 22 attains a stable fully opened position, the linkage will hold the upper leg segments in position. It should therefore be apparent that the link mechanism provides a means for detaining the upper leg segments in fully extended position when the linkage 22 is in its fully opened position.

The linkage also provides a means for opposing the axially downwardly directed forces acting upon the moveable upper leg segments and resulting from the applied weight of a person seated on the stool.

FIG. 14 illustrates a collapsible lounge chair having a base of support which includes two collapsible leg assemblies 16, 16 and is included to illustrate another article of collapsible metal furniture embodying the present invention.

The invention claimed is:

1. Collapsible article of furniture comprising:

at least one support assembly including axially elongate longitudinally extending first and second upper support segments and axially elongate longitudinally extending first and second lower support segments, and a linkage having a first link coupling said first upper support segment to said first lower support segment and a second link coupling said second upper support segment to said second lower support segment, said first and second links being connected each to the other to move said segments between an open position wherein said respective first and second upper support segments and said respective first and second lower support segments are spaced apart to form a generally X-shaped configuration and a closed position wherein said first and second upper support segments and said first and second lower support segments are generally parallelly aligned, wherein said first and second upper support segments are mounted on said first and second links for longitudinal axial movement relative thereto, said first upper support segment being longitudinally axially aligned with and movable into said second lower support segment and said second upper support segment being longitudinally axially aligned with and movable into said first lower support segment when said support assembly is in said closed position, wherein said support assembly further includes means for preventing said upper support segments from entering said lower support segments until said upper and lower segments are in the closed position and longitudinally axially aligned with each other, said preventing means comprising the first link, the second link, and a control link disposed between said first and second links and movable in response to the movement of said first and second links.

2. Collapsible article of furniture as set forth in claim 1 wherein said first and second links are pivotally connected for movement relative to each other.

3. Collapsible articles of furniture as set forth in claim 2 wherein said first and second lower support segments are respectively connected in fixed position to said first and second links.

4. Collapsible article of furniture as set forth in claim 1, wherein said means for preventing includes two control links, each said control link being associated with one of the first and second upper support segments for preventing said respective upper support segment from entering its respective lower support segment until said upper and lower segments are in the closed position and longitudinally axially aligned with each other.

5. Collapsible article of furniture comprising:

at least one collapsible leg assembly including first and second collapsible legs, said first leg having a first upper leg segment and a first lower leg segment and said second leg having a second upper leg segment and a second lower leg segment, a first link coupling said first upper leg segment to said first lower leg segment, and a second link coupling said second upper leg segment to said second lower leg segment, wherein said first and second links are pivotal relative to each other to move said legs to and from a closed position, said first upper leg segment of said first leg being mounted on said first link to telescope into said second lower leg segment on said second leg when said legs are in said closed position and said second upper leg segment of said second leg is mounted on said second link to telescope into said first lower leg segment of said first leg when said legs are in said closed position, and wherein said leg assembly includes means for preventing said upper leg segments from telescoping into said lower leg segments until said leg assembly is in said closed position, said preventing means comprising the first link, the second link, and a control link disposed between said first and second links and movable in response to the movement of said first and second links.

6. Collapsible article of furniture as set forth in claim 5, wherein each of said upper leg segments is movable relative to an associated link between an extended position wherein it projects in an upward direction from said link and a retracted position wherein it is partially telescopically received within an associated one of said lower leg segments.

7. Collapsible article of furniture as set forth in claim 6 wherein said leg assembly is in an open position when said upper leg segments are in said extended position and the legs cross each other presenting a generally X-shaped configuration.

8. Collapsible article of furniture as set forth in claim 5, wherein said preventing means comprises means for positioning said upper leg segments in extended positions as said leg assembly moves into said open position.

9. Collapsible article of furniture as set forth in claim 8 wherein said preventing means comprises means for detaining said upper leg segments in said extended positions while said leg assembly remains in said open position.

10. Collapsible article of furniture comprising:

at least one leg assembly including:

substantially identical generally longitudinally elongated first and second collapsible legs, said first leg having a first upper segment and a first lower segment, said second leg having a second upper segment and a second lower segment, and a linkage including first and second links pivotally connected by a pivot pin for limited pivotal movement about a common central axis extending transversally of said linkage, said first lower segment and said first upper segment being coupled to each other by said first link to form said first leg, said second lower segment and said second upper segment being coupled to each other by said second link to form said second leg, said first and second lower segments being fixedly mounted on said first and second links, said first and second upper segments being movably mounted on said links, wherein said first and second links are transversally spaced and define a substantial gap therebetween, said leg assembly having an extended position wherein said first and second upper segments extend upwardly from said first and second links and a closed position wherein said upper segments are in longitudinal axial parallel relation to each other and said lower segments of said first and second legs are in longitudinal axial parallel relation to each other, said upper segment of said first leg being downwardly movable into said lower segment of said second leg and said second upper segment of said second leg being downwardly movable into said lower segment of said first leg when said leg assembly is in said closed and extended positions, said leg assembly being movable from said closed and extended positions to an open position wherein said first and second legs cross each other at said common axes and present a generally X-shaped configuration, and wherein said leg assembly includes first and second control links supported to pivot on the pivot pin within the gap between the first and second links, each control link being connected to an associated one of said first and second links to move with said links and relative to each other to prevent movement of either of said upper segments into said lower segments until said leg assembly is in said closed position.

* * * * *